United States Patent [19]

Scribner

[11] 4,277,997

[45] Jul. 14, 1981

[54] CAPACITANCE CONTROL SYSTEM FOR PNEUMATIC PUNCH PRESS FEEDERS

[76] Inventor: Albert W. Scribner, 6 Country Club Rd., Darien, Conn. 06820

[21] Appl. No.: 20,268

[22] Filed: Mar. 14, 1979

[51] Int. Cl.[3] ..... B65H 17/36

[52] U.S. Cl. ..... 83/225; 83/250; 83/277; 226/150; 226/162

[58] Field of Search ..... 83/225, 250, 277; 226/150, 162–166

[56] References Cited

U.S. PATENT DOCUMENTS

| | | | |
|---|---|---|---|
| 2,803,335 | 8/1957 | Powers | 226/166 |
| 3,038,645 | 6/1962 | Nordlof | 226/126 X |
| 3,846,997 | 11/1974 | Leis | 226/162 X |
| 4,140,261 | 2/1979 | Scribner | 226/151 X |

*Primary Examiner*—J. M. Meister

[57] ABSTRACT

An improved multi-stroke control system for a pneumatically operated feeder for punch presses and the like; such system including means to charge and discharge a pneumatic capacitance. The pneumatic capacitance is adapted to be charged in response to the initiation of a first operative cycle of the feeder and to be discharged in response to the completion of said first cycle; said discharge being adapted to initiate a second operative cycle of said feeder. Once triggered the feeder may execute a number of successive operative cycles, the particular number being dependent on the effective volume of said pneumatic capacitance.

15 Claims, 1 Drawing Figure

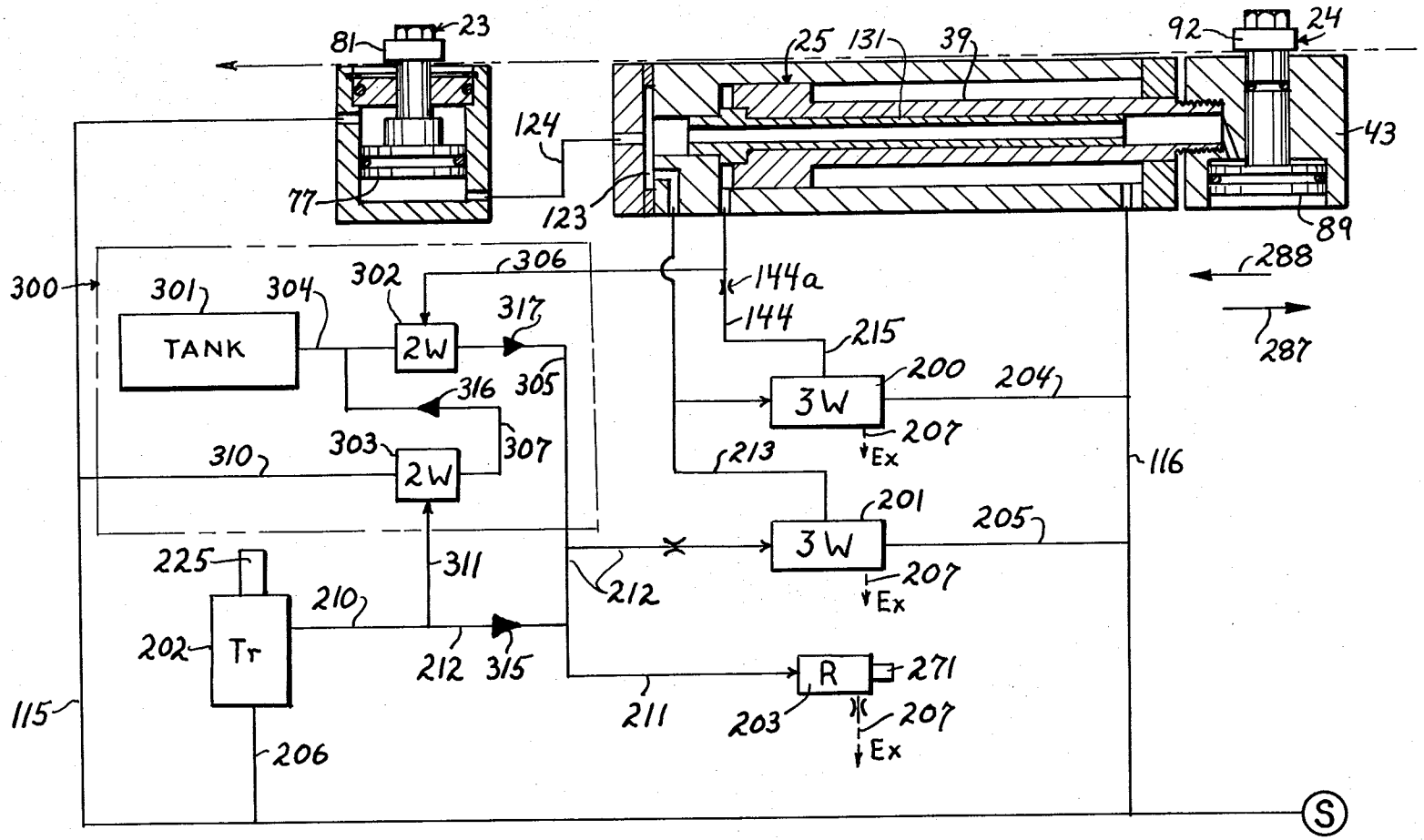
TANK
Tr
3W
3W
R
2W
2W
Ex
Ex
Ex
S

CAPACITANCE CONTROL SYSTEM FOR PNEUMATIC PUNCH PRESS FEEDERS

BACKGROUND OF THE INVENTION

There are presently commercially available multiple stroke pneumatic control systems for punch press feeders that function so that the feeder controls the initiation of each press cycle of operation; this type of control arrangement in practice being relatively expensive and cumbersome to set up and use. Such repeater controls are not intended for use where the press is to run continuously and control the feeder so that the latter executes a plurality of stock feed strokes in response to each operative cycle of the continuously running press. It is desirable to be able to interface and control the operation of a single slide feeder in this last mentioned manner particularly where a very simple set-up procedure is desired for physically interfacing the feeder with the press.

One object of the invention is to provide a novel repeater or multi-stroke control arrangement for single slide pneumatic feeders whereby the feeder may be automatically repetitively cycled so as to produce a predetermined number of stock feed strokes for each cycle of operation of a continuously running press.

Another object of the invention is to provide a novel repeater control arrangement wherein a pneumatic capacitance is utilized as part of the control for automatically recycling a punch press feeder.

A further object of the invention is to provide an improved multi-stroke control system for a pneumatic feeder wherein a first control signal is initiated so as to produce a first operative stroke of the feeder and at the same time to store a predetermined amount of pressure fluid that is adapted when released to initiate a second operative stroke of the feeder.

SUMMARY OF THE INVENTION

The present invention provides a novel repeat cycle control system for a pneumatic punch press feeder. A trigger means for the feeder is adapted to be operated by the movement of the press ram so as to initiate a first feed-index cycle of operation of the feeder and also to charge a pneumatic capacitance. In response to the completion of said first feeder cycle of operation the pneumatic capacitance is adapted to be discharged so as to thereby initiate a second cycle of operation of the feeder. A desired number of such repeat feeder cycles of operation may be selected by appropriately adjusting the volumetric capacity of said pneumatic capacitance.

BRIEF DESCRIPTION OF THE DRAWINGS

The drawing shows a pneumatic circuit diagram which illustrates the control system of the present invention.

DETAILED DESCRIPTION OF THE INVENTION

The present multi-feed stroke control system comprises a capacitance network 300 that may be combined with any suitable pneumatic control system for controlling a feeder; and for illustrative purposes said network will be shown and described as integrated with the control system described in my copending application Ser. No. 020,174, filed on Mar. 13, 1979 and entitled Control System for Pneumatic Punch Press Feeders.

For review purposes the feeder and associated control system of said copending application includes a feed slide 43 that is adapted to be reciprocally actuated by a main double-acting fluid motor 25 in index and feed directions 287 and 288 respectively. Stock gripping means 24 carried by the feed slide is adapted to be moved between stock gripping and stock release conditions by means of a single-acting fluid motor means 89 while stock clamping means 23 is adapted to be moved between stock clamping and stock release conditions by means of double-acting fluid motor means 77. The feed slide 43 is normally disposed in an indexed or right position as viewed in the drawing and is adapted when control plunger 225 is depressed from and then restored to its illustrated normal position by the action of the punch press ram to partake of a feed stroke in the feed direction 288 and after completion of said feed stroke to automatically return in an index direction 287 to its said normal indexed position where, but for the capacitance network 300 of the present invention, it would remain until the control plunger 225 is again actuated to initiate the next feed-index cycle of movement of the feed slide 43. If further details of the construction and/or operation of the above described control system are desired reference may be made to said copending application.

The multi-feed stroke capacitance network 300 is incorporated in the above described control circuit so as to cause said feed slide 43 to partake of a second feed-index cycle of movement in response to the completion of said first feed-index cycle of slide movement. The capacitance network 300 comprises a tank or pneumatic capacitance 301 and two conventional type normally closed piloted two-way valves 302 and 303 which respectively control the discharging and charging of the pneumatic capacitance 301. A line 304 is connected between the capacitance 301 and the inlet to valve 302 while the output line 305 of valve 302 is connected to the control line 212 for the main valve 201. The pilot control line 306 to valve 302 for controlling the discharge of capacitance 301 is connected to the control line 144 for the head end of the main fluid motor 25; the valve 302 being arranged so as to be actuated to its open condition when the fluid pressure in pilot line 306 reaches approximately 85 to 90% of the supply line pressure. The capacitance 301 is adapted to be charged through an output line 307 of the two-way valve 303, the inlet line 310 thereof being connected to the pressure fluid supply line 115. The pilot control line 311 for valve 303 is connected to the trigger output line 210. Suitable conventional check valves 315, 316 and 317 are provided as shown in said lines 212, 307 and 305 respectively, and suitable line restrictions, such as **144*a*, shown in lines 144, 207 and 212 may be used so as to afford any desired circuit time delay and/or speed control actions desired as is well understood in the art. Exhaust lines 207 are shown for valves 200 and 201 and the reversing valve 203**.

The operation of the present multi-feed stroke control system will now be described. With the feed slide 43 at rest in its said normal indexed position the trigger output line 210 and associated lines 212, 211, 311 and 305 will have been exhausted through reversing valve 203 so that the normally closed main valve 201 will exhaust its output line 213 whereby clamp bar 81 will be moved to a stock clamping position and the stock grip bar 92 will be moved to a stock release position by suitable spring means associated therewith. Exhausting of line 213 will also cause the other main valve 200 to assume its normal open condition so that fluid motor 25 will maintain feed slide 43 in its said index position. Also in this condition of the circuit the capacitance 301 is effectively empty, the now pressurized control line 306 (from line 144) maintaining the two-way valve 302 in an open condition while the exhausted control line 311 allows the two-way valve 303 to remain in a normally closed condition.

When the plunger 225 is operated so as to initiate an output pressure pulse, in the manner described in detail in said copending application, the output line 210 thereof and its associated lines 311, 212, 305 and 211 will be pressurized so as to initiate a first feed-index cycle of movement of said feed slide as above described. When line 311 is so pressurized the tank charging control two-way valve 303 will be opened so as to charge or pressurize the capacitance 301 by permitting pressure fluid (e.g. air) to flow from supply line 115 and through line 310, the valve 303, and lines 307 and 304 to said tank. This charging of the capacitance 301 will be completed very shortly after the feed slide 43 starts its feed stroke in the feed direction 288 during which time the exhausting of the main fluid motor through line 144 will also cause the pilot line 306 for the two way valve to be exhausted whereupon two-way valve 302 assumes its closed condition. When this feed stroke is completed and the return stroke of the feed slide 43 is initiated due to the operation of reversing valve 203 as above described the fluid pressure in line 144 servicing the main fluid motor 25 will rise but due to the differential effective areas on both sides of the main piston thereof and the fact that there is no operative stock feeding load on the slide 43 the fluid pressure in the head (left) end of the fluid motor 25 will not reach 85 to 90% of line pressure until after completion of the said index stroke of said first feed-index cycle. When this occurs the pressure in the head end of the fluid motor 25 and thus in the pilot control line 306 will now be sufficient to open the tank discharge control two-way valve 302 so that the stored pressure fluid in capacitance 301 can now flow through valve 302, through line 305 to said control lines 211 and 212 so that the main valve 201 is again operated so as to initiate a second feed-index cycle of movement of the feed slide; the check valves 315, 316, 317 preventing any undesired back flow in their respective lines so as to facilitate initiation of said second feed-index cycle of movement of the feed slide 43. Upon completion of said second feed-index cycle the two-way valve 302 of the capacitance network 300 will again be opened as above described, however in that the capacitance is now empty (i.e. incapable of triggering the valve 201) a third feed-index cycle will not be initiated and the feed slide will remain in its indexed position until the control plunger 225 is again actuated whereupon two more feed-index cycles of the feed slide will be executed. As will be apparent the capacity of tank 301 may be selected or varied so as to cause said feed slide to automatically partake of any desired number of consecutive feed-index cycles of movement for each actuation of the control plunger 225. The pilot control line 306 which effectively senses the pressure in the head end of fluid motor 25 may be connected as shown to line 144 at a point downstream from the restriction 144a or may be connected directly to said head (left as seen in the drawing) end of said fluid motor 25; so as to be directly exposed to the effective fluid pressure in said head end of motor 25.

As may be seen then the present improved press controlled feeder with its control circuitry is capable of generating two (or other predetermined number) stock feed strokes for each cycle of operation of a continuously running punch press or other apparatus with which the present feeder is to be used and will thus permit for example a single slide feeder having a maximum single feed stroke capability of say nine inches to afford a maximum effective feed stroke of 18 inches by generating two nine inch feed strokes for each cycle of the press. As may be seen then the present control system with its capacitance network 300 affords a relatively simple and inexpensive recycle control means.

I claim:

1. A pneumatic feeder for intermittently advancing stock into the work station of a punch press or the like; comprising a frame;

stock transport means movably mounted on said frame;

pneumatic motor means for actuating said transport means;

valve means for controlling the operation of said pneumatic motor means;

actuating means for said valve means;

a first control means adapted when actuated to control said valve actuating means so as to cause said stock transport means to partake of a first cycle of movement thereof; and a second control means adapted when actuated to control said valve actuating means so as to cause said stock transport means to partake of a second cycle of movement thereof;

said second control means including a pneumatic capacitance that is adapted to be charged with pressure fluid and means responsive to the subsequent discharge of said capacitance for causing initiation of said second cycle of movement of said stock transport means.

2. Apparatus as defined by claim 1 wherein said first control means includes means adapted to be operated in response to each cyclic operation of said press to cause said valve means to initiate said first cycle movement of said stock transport means and to cause said capacitance to be charged with pressure fluid.

3. Apparatus as defined by claim 1 or 2 wherein said second control means includes means for discharging said capacitance in response to the completion of said first cycle of movement of said stock transport means so as to cause initiation of said second cycle of movement of said transport means.

4. Apparatus as defined by claim 1 or 2 wherein said stock transport means is adapted to move through feed and index strokes during each of said cycles of movements, and wherein said valve means includes means for causing said stock transport means to initiate an index stroke in response to the completion of a feed stroke thereof.

5. Apparatus as defined by claim 3 wherein said second control means includes a pressure sensitive valve means.

6. In a pneumatic feeder for intermittently advancing stock into the work station of a punch press or the like, and having a frame;

a feed slide reciprocally mounted on said frame for movement in feed and index directions;

stock gripping means carried by said feed slide;

fluid motor means operative to cause said feed slide with said stock gripping means to execute operative feed and index strokes in said feed and index directions respectively; and valve means for controlling the operation of said fluid motor means;

the improvement comprising a multi-cycle control system for controlling the operation of said valve means whereby said feed slide may execute a plurality of consecutive operative cycles, said control system including a first control means adapted when operated to cause said feed slide to partake of a first operative cycle thereof; and a second control means operative in response to the terminal portion of said first operative cycle for initiating a second operative cycle of said feed slide; said second control means including a pneumatic capacitance; means responsive to the operation of said first control means to cause said capacitance to be charged with pressure fluid; and means responsive to the completion of said first operative cycle of said feed slide to discharge pressure fluid from said pneumatic capacitance and thereby initiate said second operative cycle of said feed slide.

7. Apparatus as defined by claim 6 wherein said first control means includes a trigger plunger that is adapted to move substantially parallel to and in response to the movement of the ram of said press.

8. Apparatus as defined by claim 6 wherein said pneumatic capacitance has a selected capacity so as to produce a desired number of feed strokes for each operation of said first control means.

9. Apparatus as defined by claim 6 wherein said second control means includes a pressure sensitive valve means.

10. In a pneumatic feeder for intermittently advancing stock into the work station of a punch press or the like, and having a frame;

a feed slide means reciprocally mounted on said frame for movement in feed and index directions;

stock gripping means carried by said feed slide means;

fluid motor means operative to cause said feed slide means with said stock gripping means to execute operative feed and index strokes in said feed and index directions respectively; and valve means for controlling the operation of said fluid motor means;

the improvement comprising a multi-stroke control system for said valve means for causing said feed slide means to execute a plurality of successive feed-index cycles of movement, said control system including a first control means adapted when operated to cause said feed slide means to partake of a first cycle of movement; and a second control means adapted to cause said feed slide means to initiate a second cycle of movement after completion of said first feed-index cycle of movement thereof; said second control means including a pneumatic capacitance adapted to be charged with pressure fluid;

discharge control means for controlling the discharge of pressure fluid from said pneumatic capacitance; and operating means for operating said discharge control means so as to initiate said second cycle of movement of said feed slide means after completion of said first cycle of movement thereof.

11. Apparatus as defined by claim 10 wherein said operating means is adapted to be operated in response to the completion of said first cycle of movement of said feed slide means whereby two cycles of movement may be executed by said feed slide means in response to each operation of said first control means.

12. Apparatus as defined by claim 10 wherein said operating means includes a fluid pressure sensitive means.

13. Apparatus as defined by claim 10 or 11 wherein said first control means includes means for causing said pneumatic capacitance to be charged with pressure fluid.

14. Apparatus as defined by claims 10, 11 or 12 wherein said first control means includes trigger means adapted to initiate said first cycle of movement of said feed slide means; and means operative in response to the operation of said trigger means for causing said pneumatic capacitance to be charged with pressure fluid.

15. Apparatus as defined by claim 10 wherein said second control means includes two piloted two-way valves.

* * * * *